US005363824A

United States Patent [19]

Bonse

[11] Patent Number: 5,363,824

[45] Date of Patent: Nov. 15, 1994

[54] FUEL INJECTION DEVICE FOR INTERNAL COMBUSTION ENGINES

[75] Inventor: Bernhard Bonse, Stuttgart, Germany

[73] Assignee: Robert Bosch GmbH, Stuttgart, Germany

[21] Appl. No.: 133,027

[22] PCT Filed: Apr. 10, 1993

[86] PCT No.: PCT/DE93/00330

§ 371 Date: Oct. 8, 1993

§ 102(e) Date: Oct. 8, 1993

[87] PCT Pub. No.: WO93/22554

PCT Pub. Date: Nov. 11, 1993

[30] Foreign Application Priority Data

Apr. 25, 1992 [DE] Germany ..... 4213720

[51] Int. Cl.[5] ..... F02M 37/04

[52] U.S. Cl. ..... 123/506; 123/450

[58] Field of Search ..... 123/447, 506, 450, 458, 123/500, 501; 417/462

[56] References Cited

U.S. PATENT DOCUMENTS

| | | | |
|---|---|---|---|
| 2,391,221 | 12/1945 | Beeh . | |
| 4,450,813 | 5/1984 | Takano | 123/450 |
| 4,522,174 | 6/1985 | Babitzka | 123/458 |
| 4,562,815 | 1/1986 | Takano | 123/450 |
| 4,665,875 | 5/1987 | Larkin | 123/506 |
| 4,704,673 | 12/1987 | Babitzka | 123/450 |
| 4,884,549 | 12/1989 | Kelly | 123/506 |
| 4,940,037 | 7/1990 | Eckert | 123/506 |
| 4,964,389 | 10/1990 | Eckert . | |
| 4,971,012 | 11/1990 | Brunnel | 123/506 |
| 5,027,776 | 7/1991 | Nicol | 123/450 |
| 5,265,576 | 11/1993 | McMahon | 123/506 |

FOREIGN PATENT DOCUMENTS

| | | |
|---|---|---|
| 0381954 | 8/1990 | European Pat. Off. . |
| 046240 | 12/1991 | European Pat. Off. . |
| 103691 | 4/1973 | Germany . |
| 3843467 | 6/1990 | Germany . |

*Primary Examiner*—Carl S. Miller
*Attorney, Agent, or Firm*—Michael J. Striker

[57] ABSTRACT

A fuel injection device for internal combustion engines has a high-pressure reservoir supplied through a high-pressure pump with injection pressurized fuel and from the reservoir the fuel to be injected is drawn via two sequentially electrically controlled valve by timing and volume, and is supplied via a distributor to one or several injection points. The injection points are successively controlled by a distributor aperture of the distributor. Using a definite pressure at which to maintain the fuel in the high-pressure reservoir, a very universally controllable fuel injection device is obtained in a simple manner and with minor expenditure.

8 Claims, 2 Drawing Sheets

FUEL INJECTION DEVICE FOR INTERNAL COMBUSTION ENGINES

BACKGROUND OF THE INVENTION

The present invention relates to a fuel injection device for internal combustion engines.

More particularly, it relates to a fuel injection device which has a high pressure pump drawing fuel via a suction valve into a pump working space and delivering via a delivery valve the pressurized fuel into a high pressure reservoir, with a pressure control device which maintains the pressure to a definite value and a distributor driven synchronously with the engine and successively driving injection lines which lead to injection valves, and a first electrically controlled valve in a fuel line leading to the high pressure reservoir.

Such a fuel injection device is known from the U.S. Pat. No. 4,964,389 and the corresponding DE-A-38 43 467, in which a specified amount of fuel is metered via the electrically controlled valve in the fuel line leading away from the reservoir into an intermediate reservoir, the outlet of which can be linked with the distributor aperture via a second electrically controlled valve. The amount of fuel fed via the first electrically controlled valve to the intermediate reservoir which is pressurised by the injection pressure made available by the high-pressure reservoir is measured by the stroke of a reservoir piston which limits the intermediate reservoir, and the opening period of the first electrically controlled valve is correspondingly determined by a control device. The first electrically controlled valve thus controls the amount of fuel injected. The second electrically controlled valve is opened at the desired instant for injection, and the fuel stored by the intermediate reservoir is supplied to the relevant injection nozzle.

In this procedure, the second electrically controlled valve determines the injection timing. This device is rather elaborate in that it requires a high-pressure intermediate reservoir in addition to two electrically controlled valves.

SUMMARY OF THE INVENTION

Accordingly, it is an object of the present invention to provide a fuel injection device for internal combustion engines, which avoids the disadvantages of the prior art.

In keeping with these objects and with others which will become apparent hereinafter, one feature of the present invention resides, briefly stated, in a fuel injection device of this type, in which upstream of the first electrically controlled valve, a second electrically controlled valve is provided in a relief line connected to the distributor aperture, and for the purpose of controlling the injection time and volume the injection start is determined by opening the first electrically controlled valve while the second electrically controlled valve is closed, and the injection termination is determined by opening the second electrically controlled valve.

When the fuel injection device is designed in accordance with the present invention, it has advantage that it is constructed very simply with as few structural elements as possible.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
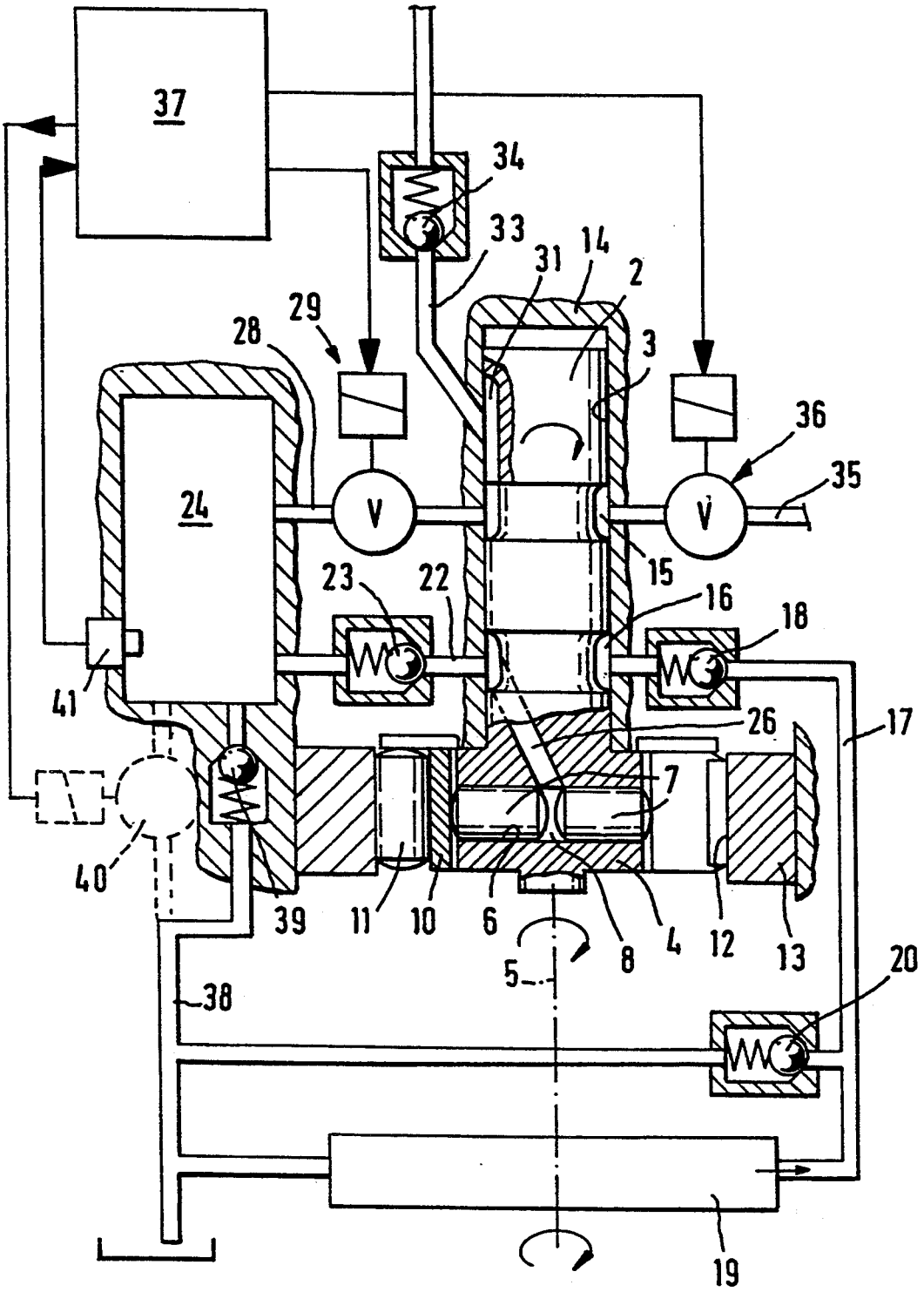
FIG. 1 shows a first embodiment example with a radial piston distributor pump as a pressure generator and as a device for controlling several fuel injection valves which are supplied with fuel from a high-pressure reservoir.

FIG. 1 shows a partial section through parts of a high-pressure pump of the type of a radial piston distributor injection pump. In this example, a distributor piston 2 is driven in a bore 3 by a rotary drive which is not shown in any detail. At the foot 4 of the distributor, pump cylinders 6 are provided which extend radially relative to its rotating axis 5, with pump pistons 7 able to move to and from which between them enclose a pump working space 8. Attaching to their outer front face are the pump pistons on roller shoes 10 with rollers 11 which during the rotation of the distributor piston, run on a cam path 12 of a cam ring 13. The cam ring is supported in the high-pressure fuel pump housing 14.

The distributor 2 has a first annular goove 15 and a second annular groove 16 at an axial separation from it. This second annular groove 16 has a fuel supply line 17 terminating in it via a filling valve 18 in the form of a non-return valve, with the fuel supply line being supplied with fuel from a fuel supply pump 19 which is driven synchronously with the distributor 2, this fuel being kept at a definite delivery pressure by means of a pressure control valve 20, which relieves the fuel supply line 17 to the suction side of the delivery pump 19. Leading off from the second annular groove 16 is a pressure line 22, in which a supply valve 23 is arranged which is constructed as a non-return valve which opens away from the annular groove 16. The pressure line 22 terminates via this supply valve 23 in a high-pressure reservoir 24. The second annular groove is continuously linked to the pump working space 8 by a pressure line 26.

The high-pressure reservoir is connected to the first annular groove 15 via a fuel line 28, in which a first electrically controlled valve 29, in this case a solenoid valve, is arranged. This annular groove is continuously connected to a distributor aperture of the distributor 2 in the form of a distributor groove 31, which extending parallel with the rotational axis of the distributor, is integrated in the surface area of the distributor and which, as the distributor is rotated, is successively connected to injection lines 23 which emanate from the bore 3. These injection lines 33 lead via a pressure valve 34, which can be designed as a standard pressure valve or as a balanced pressure valve or a constant volume valve, each connected to the engine by a fuel injection nozzle.

The first annular groove 15 also has a relief line 35 branching off, in which a second electrically controlled valve 36, in this case again a solenoid valve, is arranged. Both solenoid valves 29 and 36 are controlled by an electric control device 37.

Finally, the high-pressure reservoir 24 has a relief line 38, in which either a constant pressure valve 39 is arranged which controls a definite pressure in the high-pressure reservoir 24 and which operates mechanically, or an electrically controlled valve 40, in this case again a solenoid valve, which is controlled by the electric control unit 37 acting on signals from a pressure transducer 41, which senses the pressure in the high-pressure reservoir 24 and passes appropriate signals to the electrical control unit.

The described fuel injection unit operates as follows: When the distributor piston is driven in a rotational motion, which as a rule takes place via the crankshaft of the associated engine, synchronously with the engine speed, the pump pistons are moved to and fro, following the cams of the cam path 12 via the roller shoes 10. In an outward going movement, corresponding to a suction stroke, the pump pistons 7 draw in fuel via the filler valve 18. During the pressure stroke effected by the cams of the cam path, the pump pistons 7 will displace fuel under high pressure via the delivery valve 23 into the high-pressure reservoir until a definite preset pressure is obtained. This pressure can be set either by means of the constant pressure valve 39 or via the pressure transducer 41 in conjunction with the electrical control unit 37 and the solenoid valve 40. Until the predetermined pressure has been achieved in the reservoir 24, there will be no outflow via the relief line 38. When the set pressure is exceeded, the constant pressure valve or the solenoid valve will open in an analogous or a cyclic manner.

When the determined pressure in the high-pressure reservoir is attained, fuel can be delivered from it for high-pressure injection to the engine. This takes place via the first electrically controlled valve 29, which, controlled by the electrical control unit, is opened at a desired injection commencement, while the second electrically controlled valve 36 is closed. The fuel then flowing away from the high-pressure reservoir 24 passes via the distributor groove 31 and one of the injection lines 33 to the relevant fuel injection nozzle, to be injected. The volume of the fuel injected is controlled by the second electrically controlled valve 36, in that this is opened when the fuel injection volume is reached, so that the first annular groove 15 is relieved and the pressure in the injection line 33 or on the fuel injection valve drops below the injection pressure. With the opening of the second electrically controlled valve 36, the first electrically controlled valve 29 is preferably closed. This closing of the first electrically controlled valve can also briefly take place after the opening of the second electrically controlled valve 36. In the first mentioned case, there is a minimum loss of fuel, which has been raised to high pressure, from the reservoir 24. In the intervals between the high-pressure injection processes, a constant pressure is usually maintained by means of the pressure valve 34 in the injection line between the injection valve and the pressure valve, if the latter is designed as a constant pressure valve. Alternatively, it is possible to relieve the individual injection lines after the injection to a predetermined pressure level by the arrangement of control grooves on the distributor piston.

The arrangement of these two electrically controlled valves enables a precise fuel injection start and a precise injection termination to be achieved in the particular injection processes in the operating cycle, allowing even the smallest amounts of injected fuel to be accurately controlled. This results, in particular, as an advantage in conjunction with the high-pressure reservoir which has been raised to a constant pressure, since constant conditions of prevailing injection pressure and pressure drops exist over the entire operating range of the engine. Irregularities of fuel injection volumes, which in particular result from a speed dependency, are thus kept very small. Alternatively and in certain circumstances, throttling actions during short injection periods or high speeds, may be compensated by appropriate matching of pressure in the high-pressure reservoir.

Since the injection valves, after the opening or closing movement, engage with only one flank in the control of the injection process, the control result is less dependent on the speed of the valves in both their opening and closing procedure. In particular, it is possible without much expenditure to achieve rapid control movements of the valves. With the proposed system, advantages will also result in that the design of the cams of the cam path no longer have to be attuned to the particular conditions prevailing at the time of injection. The cam drives merely serve to make the high injection pressure available. To achieve a particularly constant injection pressure, it is of advantage to provide several pump pistons or several pump piston delivery lifts per revolution of the distributor. The delivery lifts of the pump pistons may lie within the time spans in which the fuel injection valves are also supplied from the high-pressure reservoir 24 with high-pressure fuel to be injected. This means that the reservoir is kept free from any incidental pressure pulsing during the injection processes.

The reservoir pressure can be controlled as described via an outflow control or, alternatively, via the control of a delivery volume of the high-pressure pump, which has the advantage of a lower operating force, but would require a slightly greater expense.

The design of the capacity of the high-pressure pump advantageously offers the facility of providing a high injection pressure in the reservoir 24, even at low revolutions; with a higher number of revolutions, the reservoir will be correspondingly relieved, with a possibility of relating the reservoir pressure to the number of revolutions.

The described fuel injection device is above all characterised by simple installation components with universal control facilities for injection start and volume.

Figure 2:
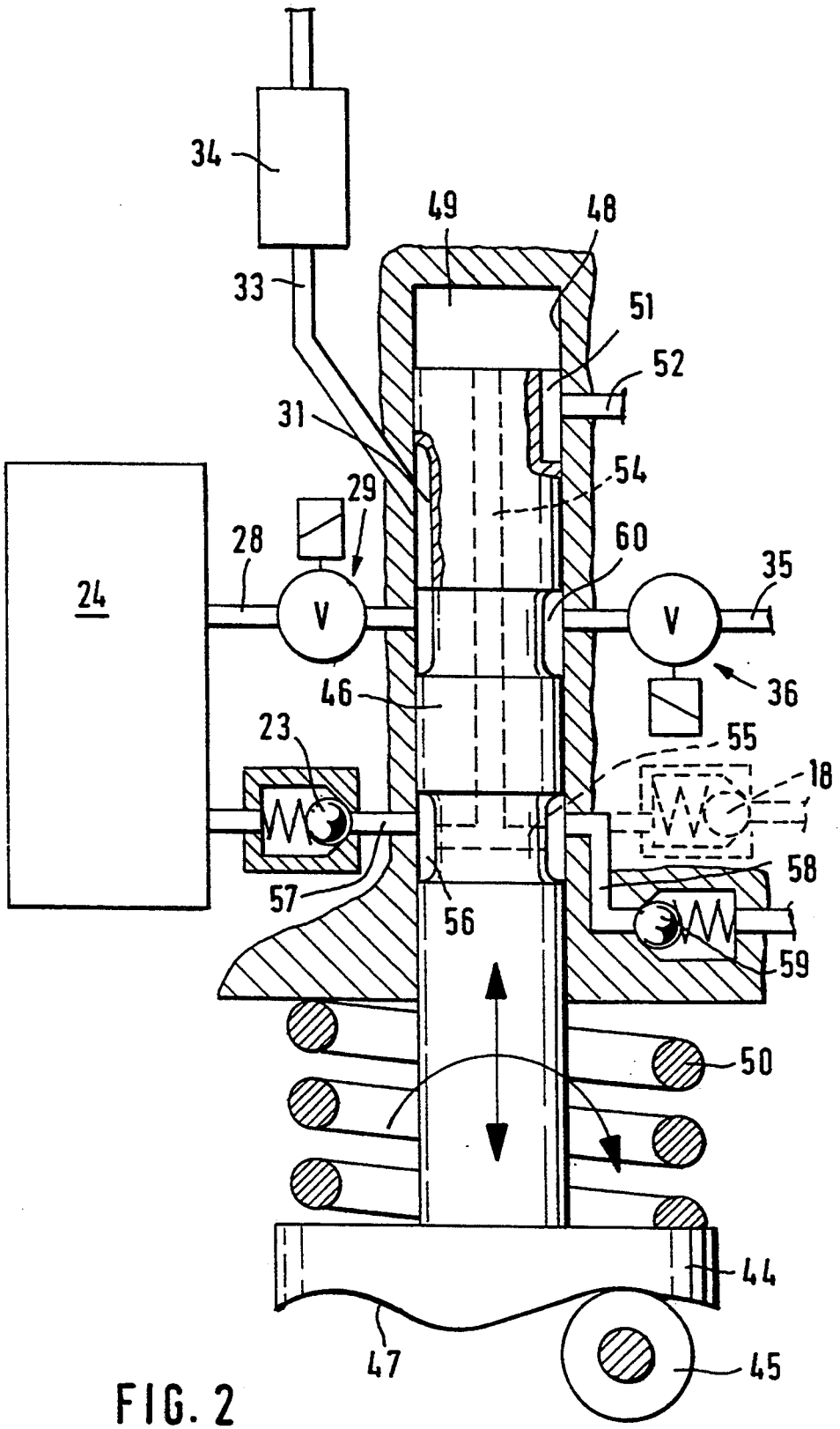
FIG. 2 shows a second embodiment example with a modified design of a pressure control device of the high-pressure reservoir of the first embodiment example.

Instead of the described radial piston pump as the generator for the high injection pressure, it is alternatively possible to use a pump of the axial piston type as in FIG. 2. Such a pump has a front cam disk 44, driven in a rotary motion, which runs on fixedly supported rollers of which only one is shown. The front cam disk is connected to a pump and distributor piston 46 which is carried in a rotary motion by the front cam disk 44 and is also moved axially on the rollers 45 in a reciprocating motion within a pump cylinder 48, in which the pump and distributor piston 46 at the front face encloses a pump working space 49.

During its revolution, the front cam disk is held in contact with the rollers 45 by a strong return spring 50, so that the pump piston 46 safely performs its suction lift. During one complete revolution, the front cam disk moves the pump piston in several reciprocating suction and delivery lifts linked to the pump working space 49. In its suction lifts, it draws in fuel via a suction groove 51 in its surface area which is linked to the pump working space 49, and via a fuel supply or suction line 52 which terminates in the pump cylinder 48. At the start of the delivery lift, the control edges which limit the suction groove, close the junction of the suction line 52, and the fuel in the pump working space 49 is compressed and passed via an axial blind hole 54, which starts from the front face of the pump piston 46, and a transverse hole 55 into an annular groove 56 in the surface of the pump piston section which is guided within the pump cylinder 48. This annular groove 56 is constantly connected to a pressure line 57, which corresponds to the pressure line 22 and terminates in the high-pressure reservoir 24 and which has a filling valve 23. Furthermore, the annular groove 56 is constantly connected to a relief line 58, in which a constant pressure valve 59 is arranged which opens towards the relief side.

In addition to the second annular groove 56, this embodiment example has a first annular groove 60 in the surface area of the pump piston 46, corresponding to the first annular groove 15 or the second annular groove 16 of the embodiment example in FIG. 1. This first annular groove 16 is connected via a fuel line 28 to the high-pressure reservoir 24 and contains the first electrically controlled valve 29. The first annular groove 60 also has the relief line 35 branching off with the second electrically controlled valve 36. Finally, the first annular groove 60 is connected to the distributor groove 31, via which one of the injection lines 31 is driven during the delivery lift via the rotation of the pump and distributor piston 46, this injection line 31 also contains a pressure valve 34 and leads to the relevant injection valve at the fuel injection pump. Insofar as the first annular groove 60 is concerned, this embodiment example is constructed in the same way as that in FIG. 1, with the width of the annular groove in axial direction of the pump piston 46 and the length of the distribution groove having to take into account the pumping lifting movement of the pump piston 46. The solenoid valves 29 and 36 are driven in the same manner as in the embodiment example of FIG. 1, and the pump lifts of the pump piston can also be designed analogously to the suggestions relating to FIG. 1. This embodiment example differs from the last example mentioned, in that a filling valve in the form of a non-return valve 18 is dispensed with, although it is still indicated by a dashed line in the drawing, and that the suction control is provided by means of the suction groove 15. In this control, it is possible that either suction grooves corresponding to the number of suction lifts of the pump piston per revolution are provided, with one suction line 52 or several suction lines, or, only one suction groove is provided, and the suction lines corresponding to the number of the suction lifts of the pump piston are distributed on the circumference of the pump cylinder 48. In terms of its life, such a control of the suction lift by means of the control edge, offers advantages over the filling valve which is designed as a non-return valve. It can also be used analogously in the embodiment example of FIG. 1. Differing from the embodiment example of FIG. 1, but also feasible in that example, is the arrangement whereby the pressure maintaining valve 59 now lies upstream from the delivery valve 23, so that an excessively high pressure rise can be reduced early. The constant pressure valve 59, in this case designed as a non-return valve, can of course be a pressure sensor controlled solenoid, analogue to the embodiment example of FIG. 1.

If the pressure generation in these examples was effected by means of pumps, corresponding to the design of standard distributor pump types, in which these pumps in addition to pressure generation for the high-pressure reservoir also take on the distributor function, it is alternatively possible to provide a high-pressure pump and a separate distributor in the known fashion. In principle, the generation of high pressure is independent of the distributor function. However, a very compact unit is obtained if a pump of the distributor pump type is used as a pressure generator.

It will be understood that each of the elements described above, or two or more together, may also find a useful application in other types of constructions differing from the types described above.

While the invention has been illustrated and described as embodied in a fuel injection device for internal combustion engines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A fuel injection device for internal combustion engines, comprising a plurality of injection lines leading to various injection valves at an engine; a high pressure reservoir; a high pressure pump having a pump working space and drawing fuel into said pump working space and delivering the pressurized fuel into said high pressure reservoir; a distributor having a distributor aperture and driven synchronously with the engine so that during its rotation said distributor successively controls said injection lines through said distributor aperture; a fuel line leading from said high pressure reservoir to said distributor aperture; a relief line leading from said distributor aperture; a first electrically controlled valve arranged in said fuel line leading from said high pressure reservoir to said distributor aperture; and a second electrically controlled valve provided downstream of said first electrically controlled valve in said relief valve leading from said distributor aperture and formed so that, for controlling an injection time and volume, an injection start is determined by opening of said first electrically controlled valve while said second electrically controlled valve is closed, and an injection termination is determined by opening of said second electrically controlled valve.

2. A fuel injection device as defined in claim 1; and further comprising a suction valve via which said high pressure pump draws fuel into said pump working space; a delivery valve via which said high pressure pump delivers the pressurized fuel into a high pressure reservoir, and a pressure control device which maintains the pressure at a definite value.

3. A fuel injection device as defined in claim 1, wherein said first electrically controlled valve is driven simultaneously with the opening of said second electrically controlled valve for its closing procedure.

4. A fuel injection device as defined in claim 1, wherein said first electrically controlled valve is closed after the opening of said second electrically controlled valve.

5. A fuel injection device as defined in claim 2, wherein said pressure control device has a relief line which contains a valve located upstream of said delivery valve.

6. A fuel injection device as defined in claim 2, wherein said delivery valve is formed as a non-return valve.

7. A fuel injection device as defined in claim 2, wherein said suction valve is formed as a non-return valve.

8. A fuel injection device as defined in claim 2, wherein said pump has a pump piston, said suction valve being formed as a control edge which is movable synchronously with a drive of said piston pump so as to establish a connection between said pump working chamber and a fuel supply chamber during a suction stroke of said pump piston and to separate said pump working chamber from the fuel supply chamber during a high pressure delivery stroke of said pump piston.

* * * * *